US008453862B2

(12) United States Patent
Wang

(10) Patent No.: US 8,453,862 B2
(45) Date of Patent: Jun. 4, 2013

(54) FOLDABLE STORAGE BOX

(76) Inventor: Wen-Tsan Wang, Taipei (TW)

( * ) Notice: Subject to any disclaimer, the term of this patent is extended or adjusted under 35 U.S.C. 154(b) by 192 days.

(21) Appl. No.: 13/093,822

(22) Filed: Apr. 25, 2011

(65) Prior Publication Data

US 2012/0267366 A1 Oct. 25, 2012

(51) Int. Cl.
*B65D 6/18* (2006.01)

(52) U.S. Cl.
USPC ..... 220/23.4; 220/9.3; 220/7; 206/504

(58) Field of Classification Search
CPC ..... B65D 6/18
USPC ..... 220/23.4, 9.2, 9.1, 9.3, 23.2, 520, 220/7; 206/503, 504
See application file for complete search history.

(56) References Cited

U.S. PATENT DOCUMENTS 2,361,743 A * 10/1944 Butler ..... 220/9.3
5,464,113 A * 11/1995 Ho et al. ..... 220/9.2
5,671,858 A * 9/1997 Hsu ..... 220/9.2
6,015,071 A * 1/2000 Adomeit et al. ..... 224/42.34
6,089,394 A * 7/2000 Ziglar ..... 220/6
2002/0079313 A1* 6/2002 Grayson ..... 220/23.4
2006/0049075 A1* 3/2006 Chen ..... 206/504
2008/0042533 A1* 2/2008 Wang ..... 312/259

* cited by examiner

*Primary Examiner* — Stephen Castellano
(74) *Attorney, Agent, or Firm* — Leong C. Lei

(57) ABSTRACT

A foldable storage box comprises a soft walled body open at its top end and closed at the opposing end, a top frame being mounted with the walled body and contiguous to the open top end, and a bottom frame being mounted with the walled body and contiguous to the closed opposing end; wherein the top frame are provided with attachment elements respectively on its bottom and side surfaces, the bottom frame are provided with attachment elements respectively on its top and side surfaces, such that separate boxes can be held in stacks or side by side with the attachment elements. A plurality of supporting bars are provided within the walled body to each serve as a support between the top and bottom frames to form a container. The supporting bars can be detached from the both frames to enable the walled body to be folded into a flat pack.

5 Claims, 8 Drawing Sheets

FOLDABLE STORAGE BOX

TECHNICAL FIELD OF THE INVENTION

The present invention relates to a foldable storage box and, more particular, to an improved structure of storage box that can be folded into a flat pack and assembled again via a plurality of supporting bars to form a container for storing objects.

DESCRIPTION OF THE PRIOR ART

In metropolitan areas, the living space is not large, however, each family member has more or less personal things such as clothing, books and magazines to be stored, which requires a clever arrangement. Generally, conventional storage boxes are integrally molded from plastics and thus the occupied space of each box is fixed and cannot be reduced. When they are not in use, they cannot be folded into a compact form and thus have a bad effect on the use of room space. Some storage boxes are made from wood or other material, the problem of unable to reduce the occupied space of a box, when they are not in use, is still existed.

Although there are some foldable storage boxes available in the market these days, due to the factors of the structural designs, the boxes cannot be folded into a flat pack configuration, and this also bring some inconvenience in the storage when the boxes are not in use.

Another conventional storage box employs a soft cloth, within which hard boards are enwrapped, to enable the box to be folded along the boundary of the soft cloth between two hard boards. In structure, they contains two handles at two lateral sides thereof in additional to the folding capability.

SUMMARY OF THE INVENTION

The primary object of the present invention is to provide a foldable storage box for storing household or personal things; whereby when the box is not in use, the box can be conveniently folded into a flat pack, when a use is required, the flat pack can be conveniently unfolded to a container for storing objects; furthermore, more than one boxes can be held in a stack or side by side to afford more space for storing objects.

According to one feature of the present invention, the foldable storage box includes a soft walled body open at a top end and closed at a bottom end, a top frame being mounted with the soft walled body and contiguous to the open top end, and a bottom being mounted with the soft walled body and contiguous to the closed bottom end. The top frame is provided with an attachment element on a top surface thereof and an attachment element on a side surface thereof. The bottom frame is provided with an attachment element on a bottom surface thereof and an attachment element on a side surface thereof, such that two separate boxes can be held in a stack or side by side with the attachment elements. A plurality of supporting bars are provided within the soft walled body, which can be each operated to serve as a support between the top frame and the bottom frame. When the box is not in use, the supporting bars can be detached from the top and bottom frames to place on the bottom surface of the walled body. When a use is required, the supporting bars can be placed upright between the top frame and the bottom frame to form a container for storing objects.

According to another feature of the present invention, the storage box further includes fastening means, whereby when the supporting bars each serves as a support between the top frame and the bottom frame, the fastening means can further strengthen the support provided by each supporting bar.

Based on the features of the invention, the technical means of the invention includes a walled body, a top frame, a bottom frame, a plurality of supporting bars, and fastening means. The walled body, being made of a soft cloth, is open at a top end thereof and closed at the opposing end to form a bottom surface thereof. The top frame, having a shape of closed loop, is mounted with the walled body and contiguous to the open top thereof and defines a first groove along a bottom surface thereof. The bottom frame, having a shape of closed loop, is mounted with the walled body and contiguous to the closed opposing end thereof and defines a second groove along a top surface thereof. The periphery of the walled body contiguous to the open top end is inserted into the first groove of the top frame. The periphery of the walled body contiguous to the closed opposing end is inserted into the second groove of the bottom frame. The supporting bars can be operated within the walled body to unfold or fold the walled body. Furthermore, each supporting bar has a length not less than the distance between the top frame and bottom frame. When a use is required, the supporting bars can be each placed upright to serve as a support within the walled body between the top frame and the bottom frame to form a container for storing objects. Fastening means can be applied between an inner surface of the walled body and each supporting bar to further strengthen the support provided by each supporting bar to prevent a slip. When the box is not in use, the supporting bars can be detached from the top and bottom frames to place on the bottom surface of the walled body to enable the walled body to be folded into a flat pack.

In the present invention, the magnets are employed as the attachment elements on the top and side surfaces of the top frame or on the bottom and side surfaces of the bottom frame. Therefore, when a box is stacked on another box, the two adjacent magnets respectively on the bottom surface of the top frame of one box and the top surface of the bottom frame of another box can attract each other to hold both boxes together; when two boxes are placed side by side, the two adjacent magnets respectively on the side surface of the top or bottom frame of one box and the side surface of the top or bottom frame of another box can attract each other to hold both boxes together.

In the present invention, fastening means is provided between an inner surface of the walled body, close to the top frame, and a top end of each supporting bar. When the supporting bars each serves as a support between the top frame and the bottom frame, the fastening means can further strengthen the support provided by each supporting bar. The fastening means includes a tab having strip of fastening tape and mounted on the inner surface of the walled body via a sewing techniques or other method, and a corresponding strip of fastening tape mounted on the top end of each supporting bar.

In the present invention, two folded over portions are respectively formed at its periphery contiguous to the open top end and its periphery contiguous to the closed opposing end of the walled body, and are respectively inserted into the grooves of the top and bottom frames.

In the present invention, the supporting bars are connected to the bottom surface of the walled body and can be operated within the walled body to unfold or fold the box.

DETAILED DESCRIPTION OF THE PREFERRED EMBODIMENTS

The technical means, function and effect of the present invention will be more easily understood by reference to the following detailed description, when taken in conjunction with the accompanying drawings.

Figure 1:
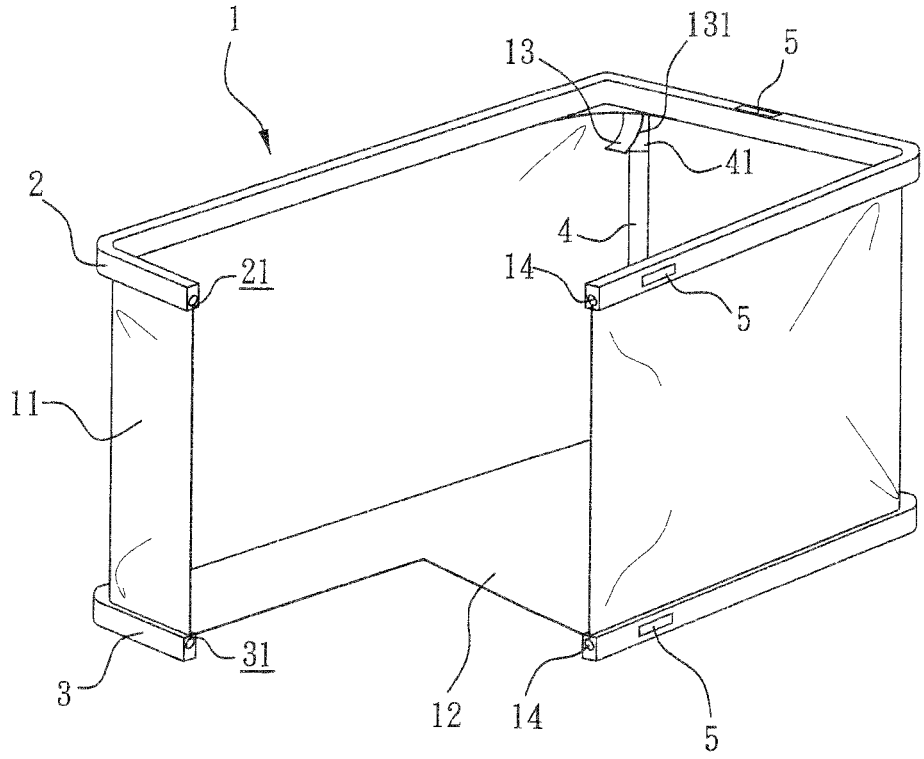
FIG. 1 is a 3-dimensional view having a partial cutout, which shows an embodiment of the present invention.
Figure 3:
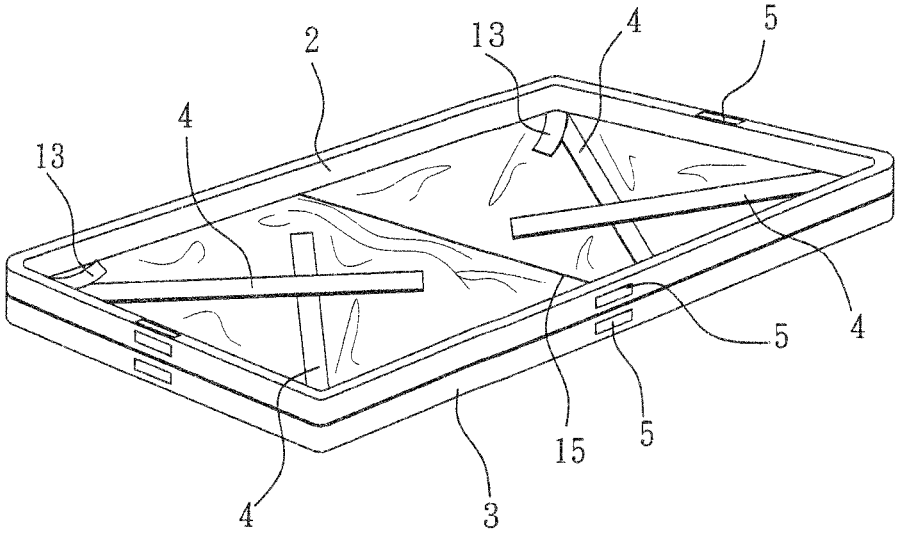
FIG. 3 is a 3-dimensional view of the present invention, which schematically shows a flat folded box.
Figure 4:
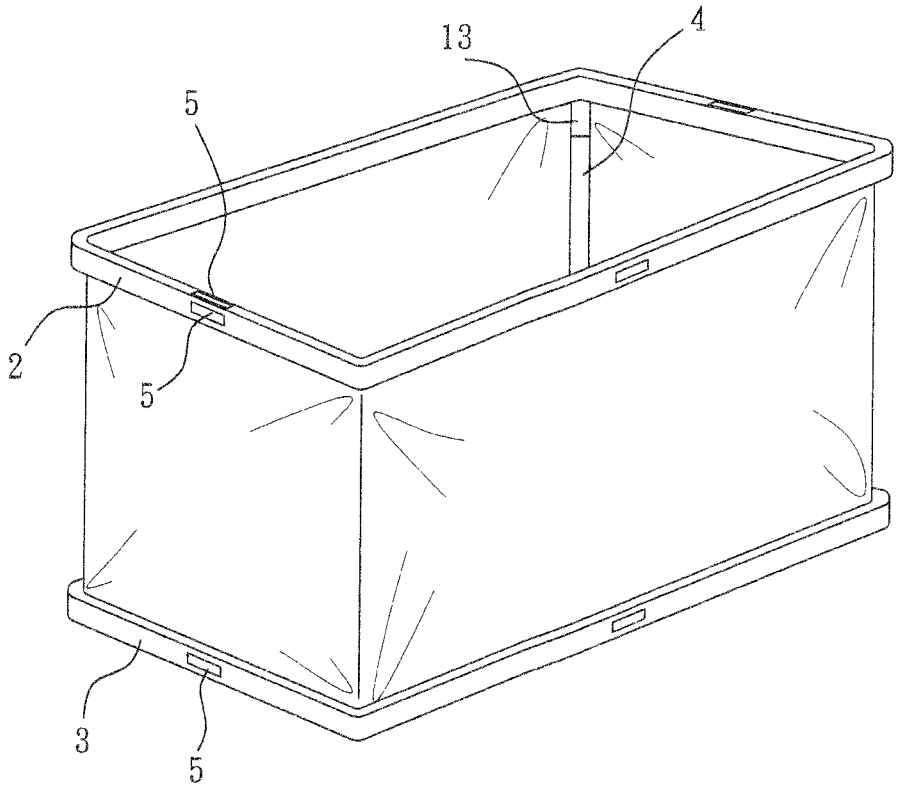
FIG. 4 is a 3-dimensional view of the present invention, which schematically shows an unfolded box.

FIGS. 1 and 4 shows an embodiment of the present invention, which comprises a walled body 1, a top frame 2 having a shape of closed loop, a bottom frame 3 having a shape of closed loop, and a plurality of supporting bars 4. The walled body, which can be made of a soft cloth, is open at a top end thereof and closed at the opposing end to form a bottom surface 12 thereof. Between the periphery contiguous to the open top end and the bottom surface 12 is a wall 11. The top frame 2 is mounted with the walled body 1 and contiguous to the open top end. The bottom frame 3 is mounted with the walled body 1 and contiguous to the closed opposing end. The supporting bars 4 are connected to the periphery of the bottom surface 12 (for example, the corners of the rectangular body) in the manner that the supporting bars 4 can be operated within the walled body 1 so as to unfold or fold the walled body. Each bar has a length not less than the distance between the top frame 2 and the bottom frame 3, or between the top frame 2 and the bottom surface 12 of the walled body 1. In such arrangement, the supporting bars 4 can be each placed upright and tightly fitted to serve as a support for the walled body 1 between the top frame 2 and the bottom frame 3, as shown in FIGS. 1 and 4; the supporting bars 4 can be detached from the top and bottom frames to enable the walled body 1 to be folded into a flat pack, as shown in FIG. 3.

Furthermore, as shown in FIG. 1, the present invention includes fastening means. In the embodiment of the present invention, the fastening means includes a tab 13 having a strip 131 of fastening tape and being mounted on an inner surface of the wall 11 close to the top frame and a corresponding strip 41 of fastening tape mounted on a top end of each supporting bar 4. The fastening tape can be a Velcro. In use, the supporting bars 4 can be each placed upright and tightly fitted within the walled body 1 to serve as a support between the top frame 2 and the bottom frame 3, and the strip 131 on the tab 13 can be affixed to the corresponding strip 41 on each supporting bar 4 to further strengthen the support provided by each supporting bar.

FIG. 1 also shows a combined structure of the wall 11 and the top frame 2 and a combined structure of the wall 11 and the bottom frame 3. As shown, a first groove 21 is defined along a bottom surface of the top frame 2, the first groove including an inner portion and an exit extending therefrom, the inner portion having a dimension greater than the exit. A second groove 31 is defined along a top surface of the bottom frame 3, the second groove 31 including an inner portion and an exit extending therefrom, the inner portion having a dimension greater than the exit. A folded over portion 14 is formed at the wall 11 contiguous to the open top end. Another folded over portion 14 is formed at the wall 11 contiguous to the closed opposing end or the bottom surface 12. In assembling the components of the present invention, the aforementioned tab 13 will be firstly mounted to the wall 11 via sewing techniques or other method. Then, the two folded over portions 14 will be respectively inserted into the first groove 21 of the top frame 2 and the second groove 31 of the bottom frame 3 to mount both frames.

Figure 6:
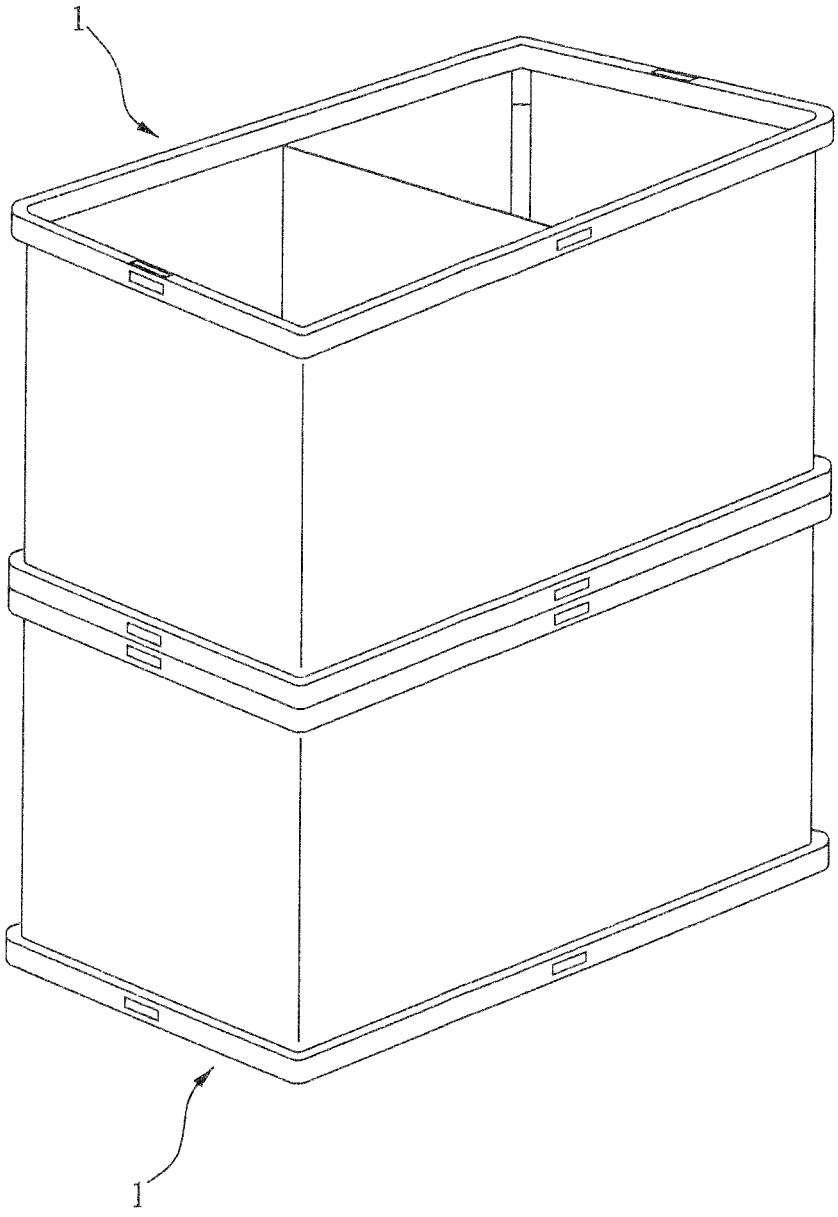
FIG. 6 is a 3-dimensional view of the present invention, which shows two boxes being held in a stack.

As shown in FIG. 1, in the top frame 2, attachment elements 5 are respectively mounted on a top surface and a side surface thereof; in the bottom frame 3, attachment elements 5 are respectively mounted on a bottom surface (not shown) and a side surface thereof. In this embodiment, the attachment elements are magnets. Other types of attachment element, such as the Velcro, can also be used. In such arrangement, when a box is stacked on another box, the two adjacent magnets respectively on a top surface of the top frame of one box and a bottom surface of the bottom frame of another box can attract each other to hold both boxes together, as shown in FIG. 6; when two boxes are placed side by side, the two adjacent magnets respectively on a side surface of the top or bottom frame of one box and a side surface of the top or bottom frame of another box can attract each other to hold both boxes together, as shown in FIG. 8.

Figure 2:
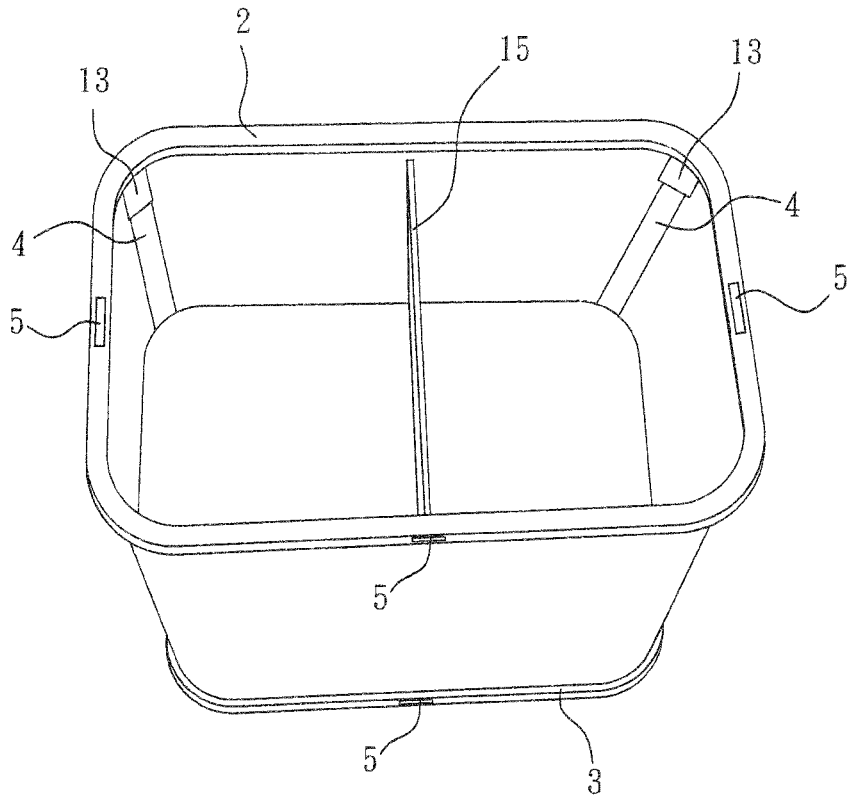
FIG. 2 is a 3-dimensional view of the present invention, which schematically shows a partitioning wall mounted in the box.
Figure 5:
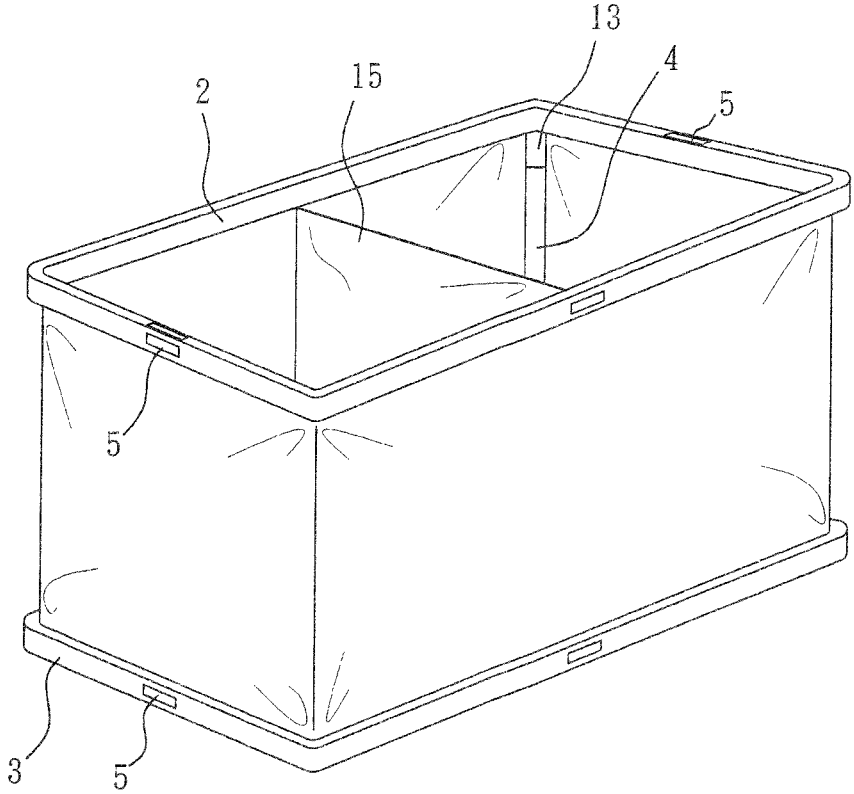
FIG. 5 is a 3-dimensional view of the present invention, which schematically shows a partitioning wall mounted in the box in an unfolded box via the supporting bars.
Figure 7:
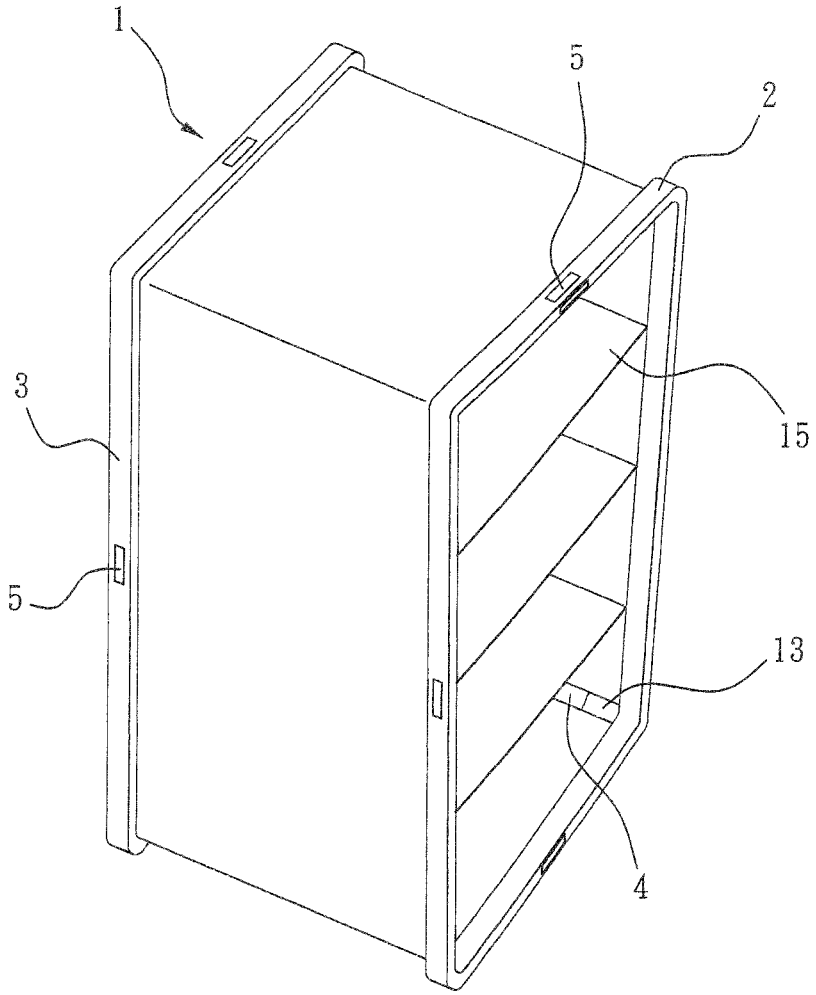
FIG. 7 is a 3-dimensional view of the present invention, which schematically shows a box being divided into separate spaces.

As shown in FIGS. 2 and 5, the walled body 1 can be further mounted with a partitioning wall 15 to divide the interior space of the walled body 1 into two separate spaces. Even more separate spaces can be divided with more partitioning walls, as can be seen in FIG. 7. Incidentally, the partitioning wall 15 can be made of a soft cloth as the wall 11 or a material different from that of the wall 11.

Figure 8:
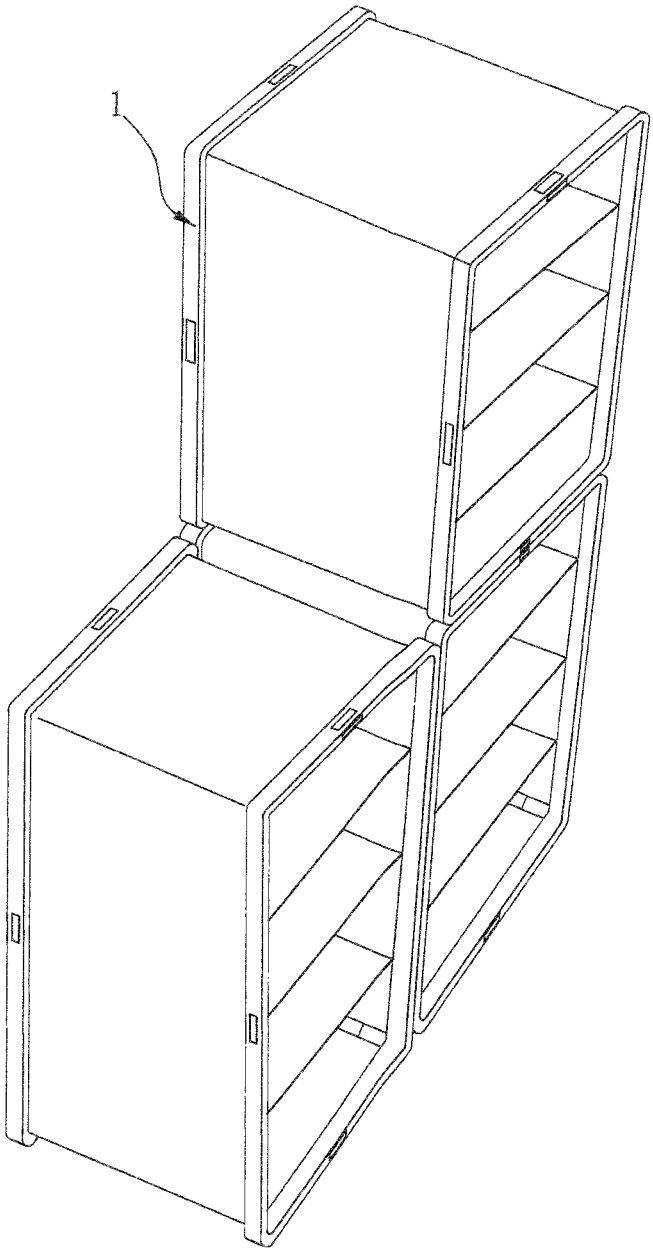
FIG. 8 is a 3-dimensional view of the present invention, which schematically shows boxes with multiple partitioning walls are held in a stack together with a side-by-side manner.

FIGS. 7 and 8 show a condition in which a storage box of the present invention can be placed upright. In such condition, the adjacent attachment elements 5 can also attach each other to enable two adjacent boxes to be held together, no matter the boxes are stacked or placed side by side.

Although the present invention has been described with a certain degree of particularity, it is understood that the present disclosure is made by way of example only and the combination and arrangement of parts may be resorted to without departing from the spirit and scope of the invention hereinafter claimed.

I claim:

1. A foldable storage box comprising a soft walled body open at a top end and closed at a bottom end, a top frame being mounted with said soft walled body and contiguous to the open top end, and a bottom being mounted with said soft walled body frame and contiguous to the closed bottom end; wherein said top frame being provided with at least one attachment element on a top surface thereof and at least one attachment element on a side surface thereof, said bottom frame being provided with at least one attachment element on a bottom surface thereof and at least one attachment element on a side surface thereof, such that two separate boxes can be held in a stack or side by side with mutual attachment of two adjacent attachment elements; a plurality of supporting bars is provided within said soft walled body to serve as a support between said top frame and said bottom frame, each supporting bar having a length not less than the distance between said top frame and said bottom frame when the box is fully unfolded, such that said supporting bars can be placed upright and tightly fitted within said soft walled body between said top frame and said bottom frame to form a container for storing objects, and said supporting bars can be detached from said top and bottom frames to enable the box to be folded into a flat pack configuration; between said soft walled body and each said supporting bar is mounted with means for fastening each said supporting bar to said soft walled body wherein said means is mounted on an inner surface of said soft walled body at one end thereof and a respective supporting bar at another end thereof to further strengthen the support provided by each said supporting bar.

2. The foldable storage box of claim 1, wherein said means for fastening each said supporting bar to said soft walled body includes a tab having a strip of fastening tape and mounted on an inner surface of said soft walled body and a corresponding strip of fastening tape mounted on each said supporting bar capable of attaching with the former strip; said top frame is defined with a groove along a bottom surface thereof, said soft walled body is formed with a folded over portion along a periphery contiguous to the open top end, said folded over portion being inserted into said groove.

3. The foldable storage box of claim 1, wherein each of said attachment elements of said top frame and said bottom frame is a magnet.

4. The foldable storage box of claim 1, wherein said supporting bars are connected to a bottom surface inside of said soft walled body.

5. The foldable storage box of claim 1, a partitioning wall is mounted inside of said soft walled body to divides said soft walled body into separate spaces.

* * * * *